US010848879B2

(12) United States Patent
As'Ad et al.

(10) Patent No.: US 10,848,879 B2
(45) Date of Patent: Nov. 24, 2020

(54) METHOD FOR IMPROVING THE SPATIAL HEARING PERCEPTION OF A BINAURAL HEARING AID

(71) Applicant: SIVANTOS PTE. LTD., Singapore (SG)

(72) Inventors: Hala As'Ad, Nepean (CA); Martin Bouchard, Cantley (CA); Homayoun Kamkar-Parsi, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/673,048

(22) Filed: Nov. 4, 2019

(65) Prior Publication Data

US 2020/0204932 A1 Jun. 25, 2020

(30) Foreign Application Priority Data

Dec. 21, 2018 (EP) ..... 18215540

(51) Int. Cl.
*H04R 25/00* (2006.01)

(52) U.S. Cl.
CPC ..... *H04R 25/552* (2013.01); *H04R 25/407* (2013.01); *H04R 25/505* (2013.01)

(58) Field of Classification Search
CPC .. H04R 25/552; H04R 25/407; H04R 25/505; H04R 25/50; H04R 25/554; H04R 25/00;
(Continued)

(56) References Cited

U.S. PATENT DOCUMENTS 10,003,893 B2 6/2018 Kamkar-Parsi

FOREIGN PATENT DOCUMENTS

EP 3148217 A1 * 3/2017 ..... H04R 25/407
EP 3148217 A1 3/2017
EP 3252764 A1 12/2017

OTHER PUBLICATIONS

Jeub M. et al.: "Model-Based Dereverberation Preserving Binaural Cues", IEEE Transactions on Audio, Speech and Language Processing, IEEE, US, vol. 18, No. 7 , Sep. 1, 2010 (Sep. 1, 2010), pp. 1732-1745, XP011310967, ISSN: 1558-7916.

* cited by examiner

*Primary Examiner* — Ahmad F. Matar
*Assistant Examiner* — Sabrina Diaz
(74) *Attorney, Agent, or Firm* — Laurence A. Greenberg; Werner H. Stemer; Ralph E. Locher

(57) ABSTRACT

The invention proposes a method for improving the spatial hearing perception of a binaural hearing aid, said binaural hearing aid comprising a first local unit and a second local unit, wherein in the first local unit, a first input signal is generated from an environment sound by a first input transducer, and a first reference signal is derived from the first input signal, wherein in the second local unit, a second input signal is generated from the environment sound by a second input transducer, and a second reference signal is derived from the second input signal, wherein from the first reference signal and the second reference signal, a first binaural beamformer signal is derived, wherein from the first reference signal and the first binaural beamformer signal, a first coherence parameter is derived, wherein from the first coherence parameter, a first mixing parameter is derived, and wherein the first reference signal and the first binaural beamformer signal are mixed by means of the first mixing parameter in order to generate a first output signal.

14 Claims, 5 Drawing Sheets

Figure 1:
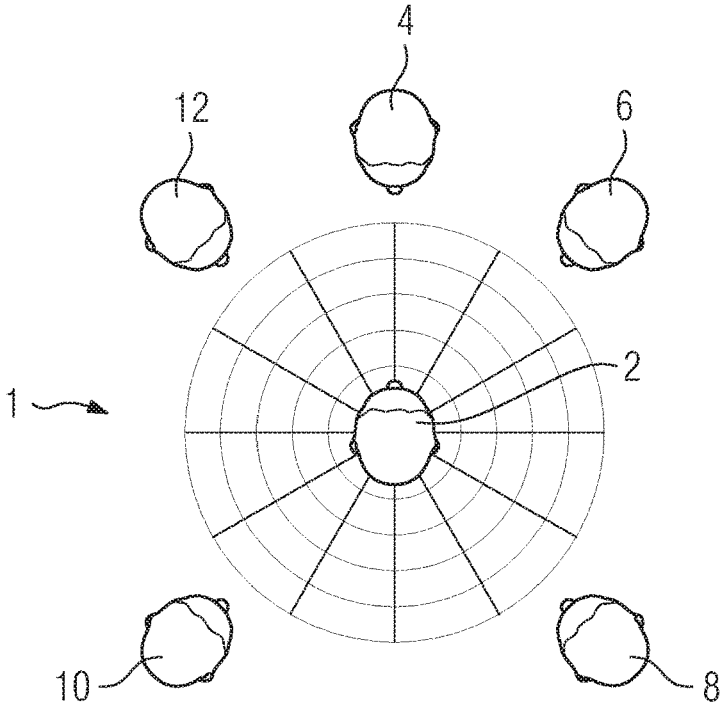

(58) Field of Classification Search
CPC ..... H04R 25/70; H04R 25/356; H04R 25/55; H04R 2460/13; H04R 2225/41; G02C 11/06
USPC ..... 381/23.1, 312
See application file for complete search history.

METHOD FOR IMPROVING THE SPATIAL HEARING PERCEPTION OF A BINAURAL HEARING AID

The invention is related to a method for improving the spatial hearing perception of a binaural hearing aid, said binaural hearing aid comprising a first local unit and a second local unit, wherein a first reference signal is generated in the first local unit from an environment sound, wherein a second reference signal is generated in the second local unit from the environment sound, wherein from the first reference signal and the second reference signal, a first beamformer signal is derived, and wherein the first reference signal and the first beamformer signal are mixed in order to generate a first output signal. The invention is further relates to a binaural hearing aid, comprising a first local unit and a secondlocal unit, said binaural hearing aid being configured to perform such a method.

Current state of the art binaural beamformers can provide noise reduction and preserve efficiently the binaural cues of the target speaker. Binaural cues enclosure all the acoustical information available to both ears of a listener for localizing a sound source. Now for an application in a binaural beamformer in which noise reduction is performed via the beamforming, the binaural cues of the target source are typically preserved, as the beamforming enhances sound from this direction. However, the typical sound environment does also comprise residual noise, which is to be reduced by the noise reduction, so that the binaural cues of the residual noise may be distorted. In particular, this may happen independently of whether the residual noise of the sound environment being a directional noise source or a superposition of few directional noise sources, or diffuse background noise. The distortion of the binaural cues of the residual noise causes a negative impact on the perception of the resulting acoustic scene.

Current state of the art solutions to this problem typically require information which may not be available neither measureable in real time applications. E. g., a solution based on the multi-channel Wiener filter requires a knowledge of statistics of the noise signals, which due to the presence of the target signals may not be available neither open to estimation. Likewise, solutions employing the interaural transfer functions assuming that for the type of noise present, the interaural transfer function is available, which in dynamic acoustic environments also is very often not the case. Another class of proposed solutions preserves the binaural cues of the noise as well as the target by applying a single real valued scalar common gain to each of the reference microphones on both sides of a hearing aid or a hearing system in order to produce the binaural outputs. However, the noise reduction is significantly reduced compared to normal beamforming methods.

It is therefore an object of the invention to find a method for operating a binaural hearing system, which permits the performance of noise reduction while still preserving as much as possible the binaural cues of the residual noise in the presence of a target sound signal. The method shall preferably achieve said object with no restrictions on the acoustic environment or on a signal-to-noise-ratio (SNR).

According to the invention, this object is achieved by a method for improving the spatial hearing perception of a binaural hearing aid, said binaural hearing aid comprising a first local unit and a second local unit, wherein in the first local unit, a first input signal is generated from an environment sound by a first input transducer, and a first reference signal is derived from the first input signal, wherein in the second local unit, a second input signal is generated from an environment sound by a second input transducer, and a second reference signal is derived from the second input signal, wherein from the first reference signal and the second reference signal, a first binaural beamformer signal is derived, wherein from the first reference signal and the first binaural beamformer signal, a first coherence parameter is derived, wherein from the first coherence parameter, a first local mixing parameter is derived, and wherein the first reference signal and the first binaural beamformer signal are mixed by means of the first local mixing parameter in order to generate a first output signal. Embodiments which show particular advantages and may be inventive in their own respect are given by the dependent claims as well as in the subsequent description.

In the context of the invention, a signal in particular is generated from the environment sound or from a given set of other signals (i.e., from at least one other signal) if there are no other contributions to the generated signal apart from the environment sound or the signals from the given set. In this respect, a signal in particular is derived from the environment sound or from a given set of other signals (i.e., from at least one other signal) if the environment sound or the signals from the given set enter as signal contributions into the derived signal, while there may possibly exist further signal contributions to the derived signal apart from the environment sound or the signals from the given set.

In particular, the first local unit and the second local unit, respectively, are to be worn by the hearing aid user on his left year and on his right ear, respectively. In this respect, the first local unit may be given either by the local unit one at the left year of the user of the binaural hearing aid, or by the unit one at the right ear of the user. Each of the first and the second local unit comprises at least one input transducer—i.e., at least the first and the second input transducer, respectively—for converting the environment sound into an electric input signal, i.e. into the first or the second input signal, respectively. In particular, each of the first and the second local unit may comprise at least two input transducers so that in each of the local units, two different input signals are generated from the environment sound by the respective input transducers. An input transducer is in particular given by an electro-acoustic transducer configured to convert the environment sound into and electric input signal, e.g. a microphone, wherein an A/D conversion may be considered to be incorporated into the input transducer.

In particular, the first reference signal may be derived directly, i.e., without signal contributions from any other signal, from the first input signal generated by the first input transducer in the first local unit, or may be taken directly as the first input signal. The first reference signal in the first case may be generated from the first input signal by preprocessing such as dynamic compression. As an alternative, the first reference signal may be derived from the first input signal and a first supplementary input signal, the latter generated by a supplementary input transducer in the first local unit. For example, the first local unit may comprise a front input transducer as a first input transducer and a rear input transducer as said supplementary input transducer, generating from the environment sound a front input signal as the first input signal and a rear input signal as said first supplementary input signal, respectively, and the first reference signal may contain signal contributions from these two signals, possibly after some pre-processing, such as frequency-dependent gain adjustment. Similar conditions may hold for the second reference signal generated in the second local unit.

Preferably, the number of input signals in the first local unit used for deriving the first reference signal corresponds to the number of input signals in the second local unit used to derive the second reference signal. Most preferably, the algorithms to generate the first reference signal and the second reference signal from the respective input signals are consistent to each other. This comprises that if the first reference signal is generated from two input signals, i.e., from the first input signal and from a first supplementary input signal, in the first local unit by sum-and-delay beamforming, then the second reference signal is generated in the second local unit from two input signals, i.e., from the second input signal and a second supplementary input signal, also by a sum-and-delay process.

Preferably, the first output signal is converted into a first output sound by a first output transducer of the first local unit. For the present invention, an output transducer may in particular be given by an electrical-acoustic transducer configured to convert and electric signal into sound, in particular by means of mechanical vibrations stimulated by the electrical signal. The first output signal may be generated from the first binaural beamformer signal and the first reference signal taking these two signals directly, e.g., as a superposition, or generated from the first binaural beamformer signal and the first reference signal as intermediate signals, to which further hearing aid specific signal processing, such as frequency dependent gain factors, but also feedback suppression may be applied prior to generating the first output signal. Said hearing aid specific signal processing and/or feedback suppression may also or alternatively be applied to the first output signal prior to converting it into an output sound by the first output transducer.

The first coherence parameter preferably is derived in such a way that it contains information about the coherence, in particular about the complex coherence function, of the first reference signal and the first binaural beamformer signal. In particular, the first coherence parameter may be taken as a function of the complex coherence function whose absolute value is monotonuous in the absolute value of the complex coherence function. The first mixing parameter may be a function which depends in a monotonous in particular a linear way on the coherence parameter or on its absolute value. The first mixing parameter may be frequency dependent or dependent on a particular frequency range or on a set of given frequency bands. The mixing parameter in particular may assign values for the mixing of magnitudes of the signals to be mixed and for the mixing of phases or an assignment of one of the signals to be mixed.

The proposed method takes into account the coherence of the first reference signal—preferably generated "locally", i.e., only from the first local unit's input signals—and the first binaural beamformer signal, in order to "restore" the binaural cues for spatial perception by means of the mixing of these two signals. The first binaural beamformer signal is typically a sort of main signal for generating the first output signal, as it may incorporate strong and efficient noise reduction techniques via the binaural beamforming, however possibly at the cost of a loss of spatial perception resolution. As a local signal, the first reference signal contains more information on the spatial cues, however also more noise in most cases. If the first binaural beamforming signal's phase and/or magnitude information differ substantially from the corresponding information of the reference signal, i.e., if these two signals loose "coherence", this means that the phase and/or the magnitude component, respectively, of the first binaural beamformer signal are somewhat "distorted" with respect to the "correct" spatial cues and perception given by the first reference signal. In this case, the "distorted" phase information of the first binaural signal may be restored by taking in account the "correct" phase information of the first reference signal, and/or the "distorted" magnitude information of the first binaural signal may be restored by taking in account the "correct" magnitude information of the first reference signal, respectively, in order to generate the first output signal. This is done by properly mixing the first reference signal and the first binaural beamforming signal, in particular frequency band-wise, and in particular for phase information and magnitude information independently.

Preferably, the method is performed in the first local unit and in the second local unit in a symmetrical way, i.e., from the first reference signal and the second reference signal, a second binaural beamformer signal is derived, from the second reference signal and the second binaural beamformer signal, a second coherence parameter is derived, from the second first coherence parameter, a second mixing parameter is derived, and a second output signal is generated from the second reference signal and the second binaural beamformer signal by mixing them by means of the second mixing parameter. The second output signal is preferably converted into an output sound by a second output transducer of the second local unit. Preferably, also further signals such as supplementary signals which characterize preferred embodiments, are generated, derived and processed in an analogous way in the second local unit.

In an embodiment, the first reference signal is derived from a set of first input signals, each of which is generated from the environment sound by a corresponding input transducer in the first local unit. In particular, this means that the first reference signal contains only signal contributions from input signals generated in the first local unit by the respective input transducers (or only from the first input signal), and in particular no signal contributions from an input signal generated in the second local unit by a respective input transducer (e.g., by the second input transducer). Thus, the spatial information of the first reference signal is limited to the first local unit, allowing the first reference signal to serve as a true "spatial cues reference" for the first binaural beamformer signal, which contains signal contributions from input signals generated in both of the local units.

In another embodiment, at least for a number of frequency bands, a magnitude of the first output signal is obtained as a linear superposition of a magnitude of the first binaural beamformer signal and a magnitude of the first reference signal, and wherein in said linear superposition, the magnitude of the first binaural beamformer signal and the magnitude of the first reference signal are mixed according to the first mixing parameter. The mixing may be of the form $$|z_{out}|=b\cdot|z_{bin1}|+(1-b)\cdot|z_{ref1}|,$$

wherein $z_{out1}$ denotes the first output signal, $z_{ref1}$ denotes the first reference signal, and $z_{bin1}$ denotes the first binaural beamformer signal. The mixing parameter b may be chosen as a function of $|C_{rer1,bin1}|$, preferably a monotonuously decreasing and in particular a linear function with function values between a maximal mixing parameter $b_{max}$ (for $|C_{rer1,bin1}|=0$) and a minimal mixing parameter $b_{min}$ (for $|C_{rer1,bin1}|=1$), wherein $C_{rer1,bin1}$ denotes the complex coherence function between $z_{ref1}$ and $z_{bin1}$.

Preferably, in dependence of the first coherence parameter, a first magnitude threshold value is derived, wherein the first mixing parameter is obtained in dependence of a comparison of the first coherence parameter with the first magnitude threshold value. If, e.g., the magnitude $|C_{rer1,bin1}|$ of the first coherence parameter is smaller than said first magnitude threshold $th_{mag1}$, i.e., $|C_{rer1,bin1}|<th_{mag1}$, a first mixing parameter of $b_1$ may be assigned, while for the contrary case, i.e., $|C_{rer1,bin1}|\geq th_{mag1}$, a first mixing parameter of $b_2$ with $b_1>b_2$, and in particular $b_1>0.5>b_2$, may be assigned.

Said first threshold value may in particular be obtained by calculating the first coherence parameter for a plurality of subsequent time-frequency bins, taking a time average of the time-frequency bins of the first coherence parameter for a given frequency band. The first magnitude threshold for said frequency band may then be taken as said time average of the corresponding time-frequency bins of the first coherence parameter, i.e., $th_{mag1}=mean_n\ \{|C_{rer1,bin1}\ (n,k)|\}$, wherein $C_{rer1,bin1}$ (n,k) is the complex coherence function in time-frequency domain with discrete time index n and frequency band index k.

If for a given time-frequency bin, the magnitude $|C_{rer1,bin1}\ (n,k)|$ of the complex coherence function is higher than the first magnitude threshold value $th_{mag1}$, this normally indicates a relatively strong local similarity between the first binaural beamformer signal and the first reference signal, with its cues essentially preserved. In other words, the noise reduction achieved by the first binaural beamformer signal is more likely comparable to the noise reduction achieved in the first reference signal, at the given time-frequency bin. Therefore, if these two signals are more likely to have similar noise reduction levels, mixing can then include a significant proportion of the first reference signal (with the spatial cues preserved). At the opposite, if the magnitude $|C_{rer1,bin1}\ (n,k)|$ of the complex coherence is lower than the threshold value $th_{mag1}$, this is an indication that the first binaural beamformer signal differs from the first reference signal. Therefore, the first binaural signal is more likely to have more noise reduction than the first reference signal, and a mixing of both can then put more emphasis on the first binaural beamfomer signal for better noise reduction.

In particular, the magnitude of the first output signal may be applied only in a certain frequency range, preferably above 1 kHz, or preferably above 1.5 kHz, or most preferably above 2 kHz.

In an embodiment, a first phase threshold value is compared to a phase of the first coherence parameter, and at least for a number of frequency bands, in dependence of said comparison a phase of the first output signal is obtained from a phase of the first reference signal and/or from a phase of the first binaural beamformer signal. Preferably, the phase of the first output signal is obtained from either the phase of the first reference signal, or from the phase of the first binaural beamformer signal. The first phase threshold value $th_{ph1}$ may be defined as a deviation from the zero phase, i.e. in terms of $th_{ph1}:=\mu\pi$ with $\mu<0.2$, preferably $\mu<0.1$.

Then, if the absolute phase (i.e. the absolute value of the phase) of the first coherence parameter is bigger than the first phase threshold value $th_{ph1}$, the phase of the first output signal is obtained from the phase of the first reference signal, preferably by taking said phase identically. For the opposite case, i.e., if the absolute phase of the first coherence parameter is smaller than or equal to the first phase threshold value $th_{ph1}$, the phase of the first output signal is obtained from the phase of the first binaural beamformer signal, preferably by taking said phase identically.

In particular, for low frequency components, i.e. below 2 kHz or below 1.5 kHz or below 1 kHz, when the absolute phase of the complex coherence function as the first coherence parameter is higher than a threshold value, this indicates significant differences between the phases of the compared signals. Therefore, the first binaural beamformer signal is more likely to have strong phase distortion locally, and the phase of the first reference signal is used, as it offers a better cues preservation. Otherwise, if the absolute phase of the complex coherence function is lower than a threshold value, the phase of first binaural beamformer signal can be used, as it more likely to have low distortion locally.

For the high frequency components, i.e. preferably above 1 kHz, more preferably above 1.5 kHz, most preferably above 2 kHz, only the phase of the first binaural beamformer signal may be used, since the phase information does not have a significant role in preserving the binaural cues for those frequency components, especially in terms of an interaural level difference. In addition, this choice allows keeping more noise reduction.

In an embodiment, the first reference signal is generated from the first input signal, wherein the second reference signal is generated from the second input signal, and wherein the first binaural beamformer signal is generated from the first reference signal and the second reference signal. This is particularly useful for small local units, e.g. in the shape of ITE instruments, which only have sufficient space for one input transducer each.

In another embodiment, a first supplementary input signal is generated from the environment sound by a first supplementary input transducer in the first local unit, wherein the first binaural beamformer signal is derived from at least the first supplementary input signal. This is particularly useful for local units with at least two input transducers each, as it allows for including two input signals from each side into the formation of the respective first and second binaural beamformer signals for better noise reduction in combination with the proposed method.

In particular, the first reference signal is generated from the first input signal, the second reference signal is generated from the second input signal, and the first binaural beamformer signal is generated from the first reference signal, the second reference signal and the first supplementary input signal. This means that only the second reference signal needs to be transmitted from the second local unit to the first local unit, and in particular, the first supplementary input signal is not transmitted from the first local unit to the second local unit. The first local unit thus receives only the second reference signal as "non-local" signal for generating the first binaural beamformer signal. This is particularly useful in cases where battery power is an issue (e.g. due to size restrictions), as the present embodiment allows for a two-local-input noise reduction while saves battery power with only one signal being transmitted.

In yet another embodiment, in the second local unit, a second supplementary input signal is generated from the environment sound by a second supplementary input transducer, and the first binaural beamformer signal is derived from the second supplementary input signal. This embodiment offers the additional advantage of the first binaural beamformer signal being dependent on two local input signals and to "non-local" input signals from the second local unit, thus allowing for a very detailed beamforming in the noise reduction process.

In particular, the first reference signal is generated from the first input signal, wherein the second reference signal is generated from the second input signal, wherein in the first local unit, a first local beamformer signal is generated from the first reference signal and the first supplementary input signal, wherein in the second local unit, a second local beamformer signal is generated from the second reference signal and the second supplementary input signal, and wherein the first binaural beamformer signal is derived from the first local beamformer signal and the second local beamformer signal. In particular, this means that in each local unit, a local beamformer signal is generated for local pre-processing such as enhancing the frontal hemisphere or similar, and the first binaural beamformer signal is generated from these pre-processed local beamformer signals, while one of the two local input signals of the first local unit is taken for the first reference signal in order to restore the spatial cues.

In yet another embodiment, in the first local unit, the first reference signal is generated from the first input signal and the first supplementary input signal as a first local beamformer signal, wherein in the second local unit, the second reference signal is generated from the second input signal and the second supplementary input signal as a second local beamformer signal, and wherein the first binaural beamformer signal is derived from the first reference signal and the second reference signal. This takes the pre-processed local beamformer signals for the generation of the respective reference signals. This process is particularly useful if a single input signal in one of the local units with two input signals each contains a lot of noise, so that the pre-processing reduces this noise while still mostly preserving the spatial cues in the reference signal.

Another aspect of the invention is given by a binaural hearing aid, comprising a first local unit with at least a first input transducer for converting an environment sound into at least a first input signal, and a second local unit with at least a second input transducer for converting the environment sound into at least a second input signal, and a signal processing unit configured to perform the method described above. The advantages of the proposed method for noise reduction in a binaural hearing aid and for its preferred embodiments can be transferred to the binaural hearing aid itself in a straight forward manner.

Figure 2:
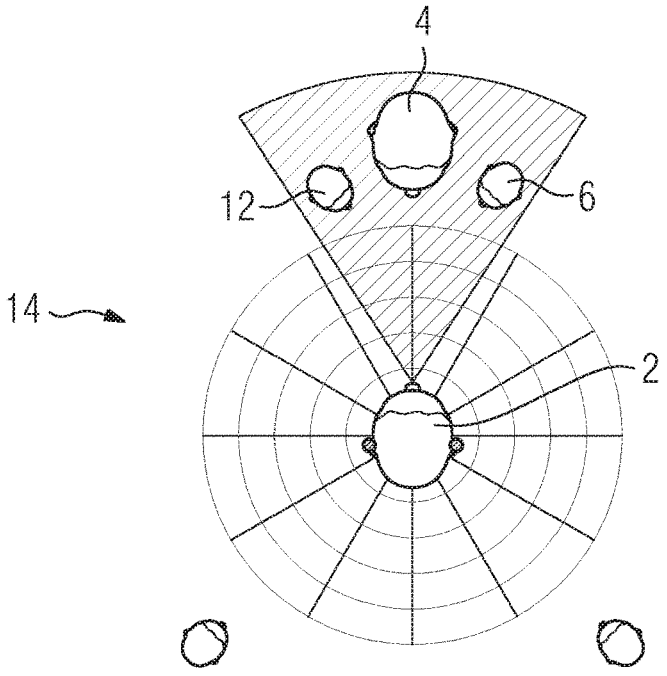
Figure 3:
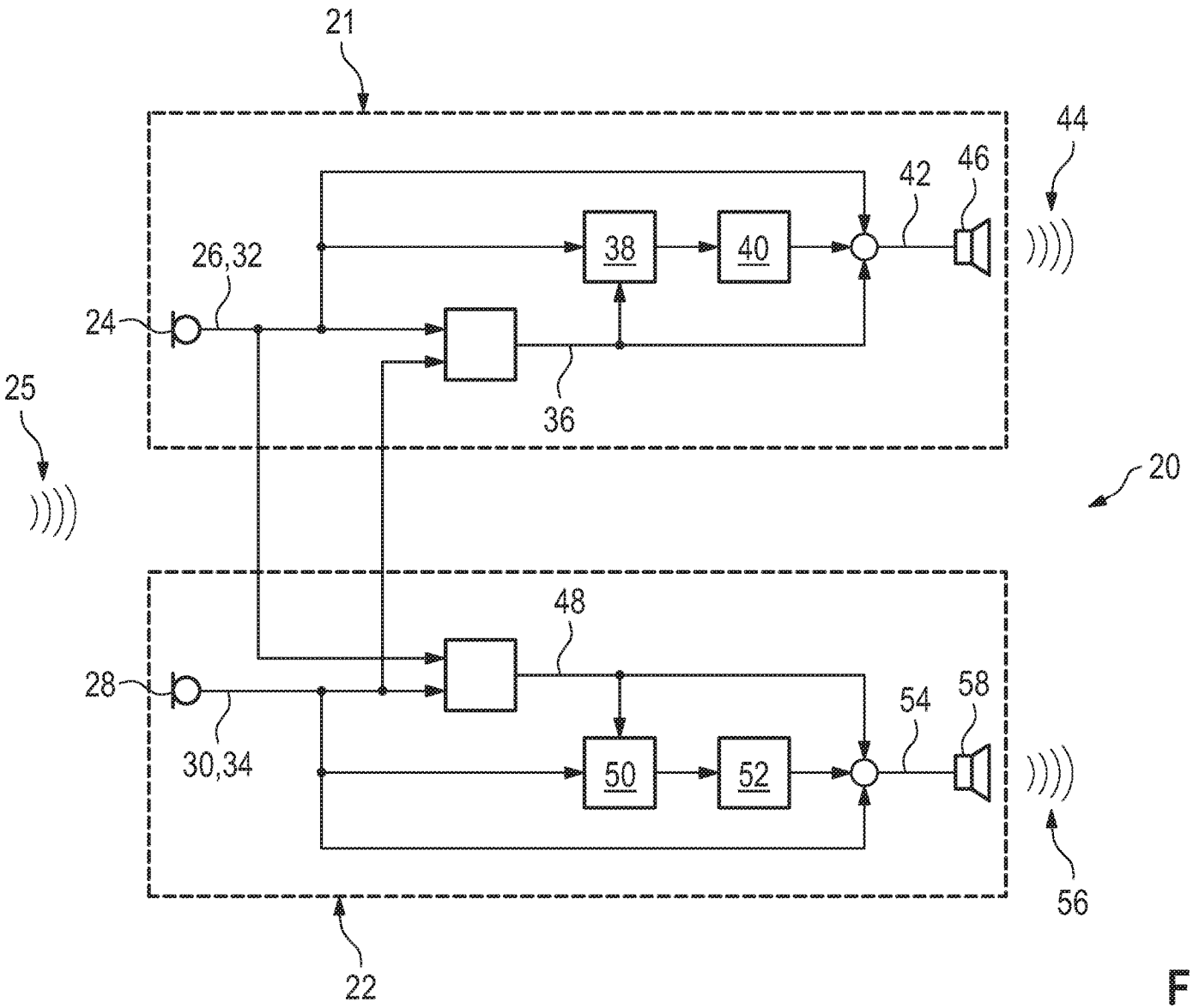
Figure 4:
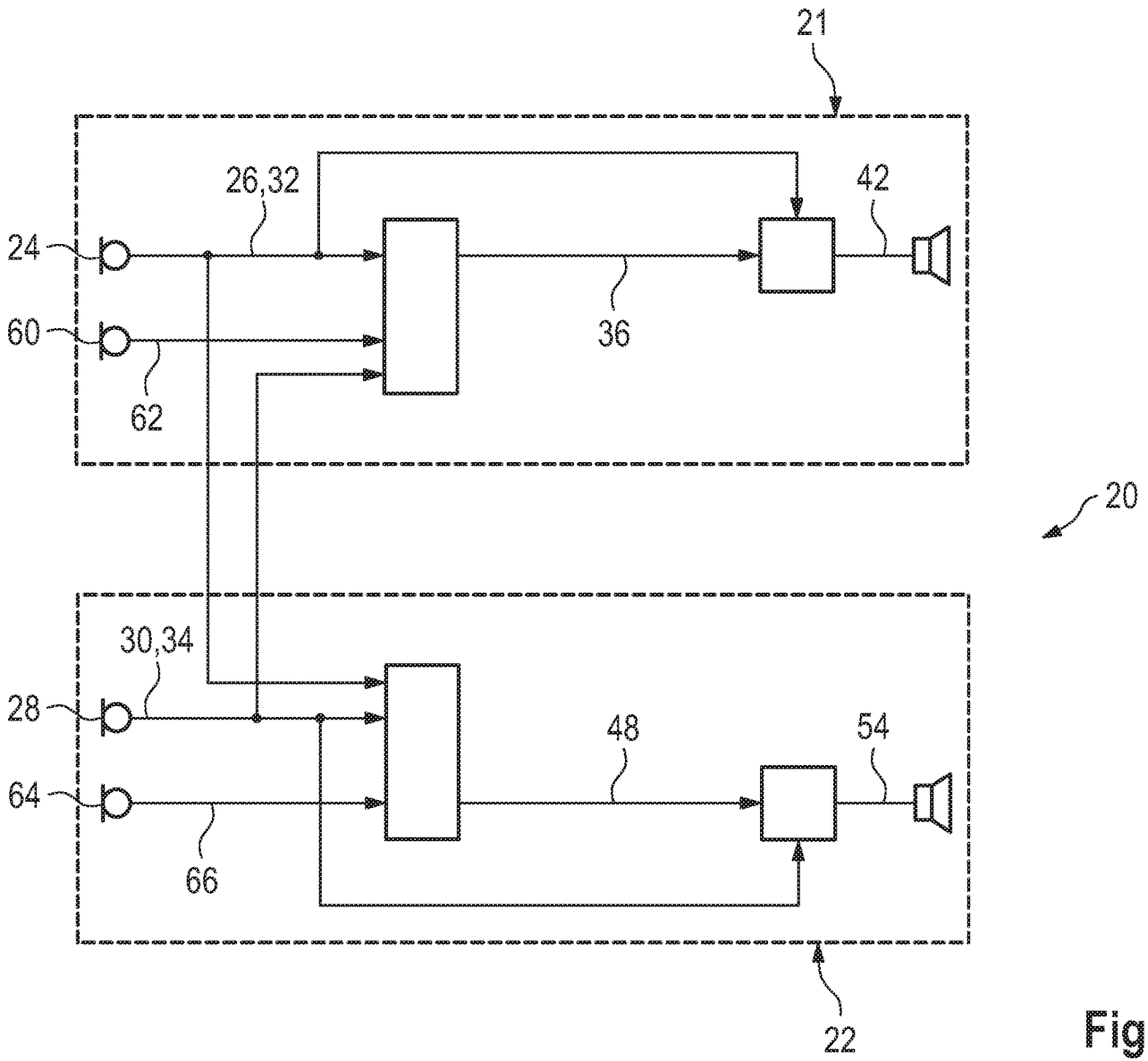
Figure 5:
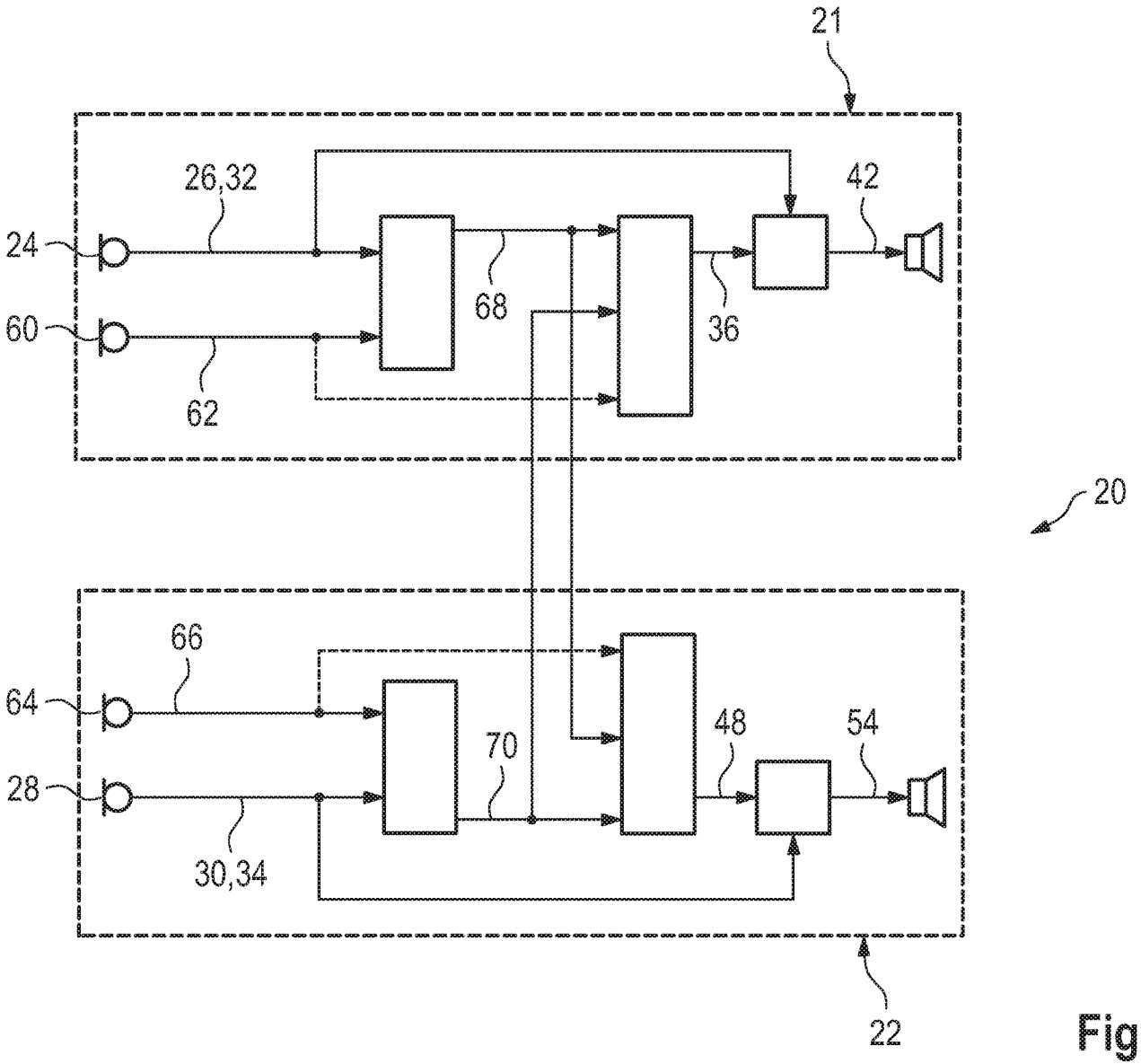
Figure 6:
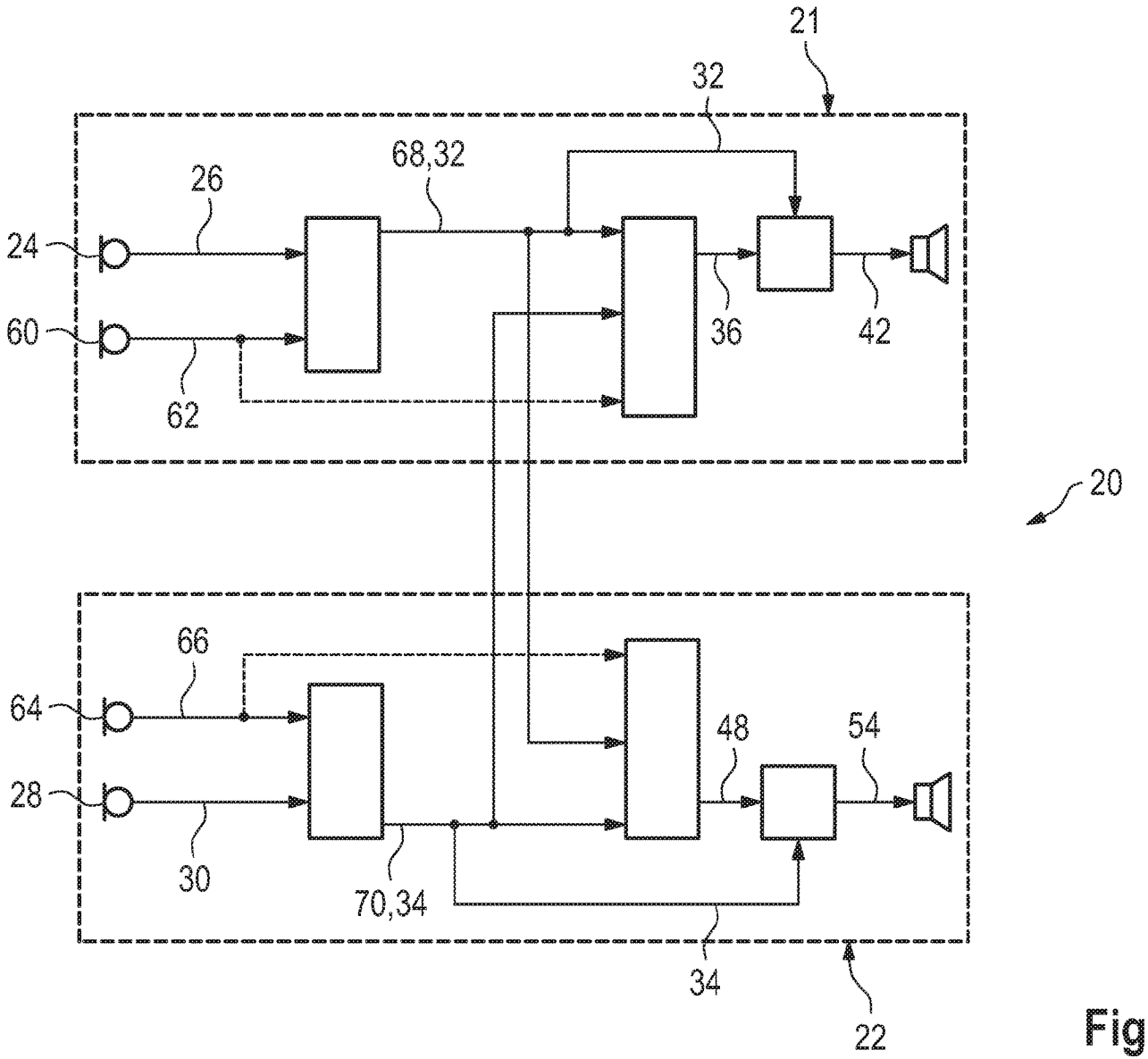

The attributes and properties as well as the advantages of the invention which have been described above are now illustrated with help of a drawing of an embodiment example. In detail, FIG. 1 shows a schematical top view of a conversation hearing situation including a user of a state-of-the-art binaural hearing system and five speakers, FIG. 2 shows a schematical top view of the conversation hearing situation according to FIG. 1, as well as the acoustical localization of the speakers as perceived by the user of the binaural hearing system, FIG. 3 shows a schematical block diagram of a binaural hearing aid with two local units, each of which comprising a single input transducer, FIG. 4 shows a schematical block diagram of a binaural hearing aid with two local units, wherein the binaural signals are generated with only one non-local signal, FIG. 5 shows a schematical block diagram of a binaural hearing aid with two local units, wherein the binaural signals are generated with two non-local signals from the respective other unit, and FIG. 6 shows a schematical block diagram of a binaural hearing aid similar to the embodiment shown in FIG. 5.

Parts and variables corresponding to one another are provided with in each case the same reference numerals in all figures.

In FIG. 1, a schematical top view of a hearing situation 1 corresponding to a conversation is shown. A user 2 of a state-of-the-art binaural hearing system (not shown) is surrounded by his conversational partners, given by the speakers 4, 6, 8, 10, 12, while directing his view towards the target speaker 4 for a given moment.

If the state-of-the-art binaural hearing system is applying a noise reduction in which noise from directions other than the one of the target speaker 4, at least partially, is aimed to be reduced via the binaural beamforming of the binaural beamforming system, the target speaker 4 will be perceived by the user 2 in the proper direction. However, the other, non-target speakers 6, 8, 10, 12, apart from having an attenuated signal volume in the output signal of the binaural beamforming hearing aid as perceived by the user 2, due to the binaural beamforming may show their binaural cues distorted when talking to the user 2 which is focused on the target speaker 4, leading to an improper perception of the acoustical localization of the non-target speakers 6, 8, 10, 12 in the perception of the user 2.

This is displayed schematically in FIG. 2. The attenuation of the signal volume of—possibly occasional—conversational contributions of the non-target speakers 6, 8, 10, 12 with respect to the signal volume of the contributions of the target speaker 4 in the output signal of the binaural hearing system is displayed by a miniaturization of the non-target speakers 6, 8, 10, 12 compared to FIG. 1. The loss of the binaural cues may lead to a wrong acoustical perception of the positions of the non-target speakers 6, 8, 10, 12 by the user 2. This means, the user 2 can see the actual positions of two intervening non-target speakers 6, 12 as spatially well separated from the target speaker 4, but due to the state-of-the-art binaural beamforming, displayed by the beam 14, and the loss of binaural cues of the non-target speakers 6, 12 caused by the noise reduction processes, the user 2 "hears" contributions from the non-target speakers 6, 12 as if those were located much closer to the target speaker 4.

FIG. 3 shows a schematical block diagram of a binaural hearing aid 20 with a first local unit 21 and a second local unit 22. The first local unit 21 comprises a first input transducer 24 for converting an environment sound 25 into a first input signal 26; the second local unit 22 comprises a second input transducer 28 to convert the environment sound 25 into a second input signal 30. The first input signal 24 serves as a first reference signal 32 for the first local unit 21, while the second input signal serves as a second reference signal 34 for the second local unit 22. For the sake of simplicity, additional signal processing steps such as a frequency dependent amplification of the input signals or dynamic compression are not represented in FIG. 3. The first input transducer 24 and the second input transducer each may be given by a microphone, e.g., an omni-directional microphone.

The first reference signal 32 is transmitted to the first local unit 21, e.g., via a wireless link, bluetooth or via near-field IR communication. In the first local unit 21, a first binaural beamformer signal 36 is generated from the first reference signal 32 and the second reference signal 34, e.g., by sum-and-delay beamforming, binaural Generalized Sidelobe Canceller (GSC)-based beamformers, binaural Minimum Variance Distortionless Response (MVDR)-based beamformers, Linearly Constrained Minimum Variance (LCMV)-based beamformers, or other adaptive methods known in the art. From the first binaural beamformer signal 36 and the first reference signal 32, a coherence parameter 38 such as the complex coherence function, is derived. From said coherence parameter 38, a first mixing parameter 40 is derived, which may be frequency-bandwise. Finally, the first reference signal 32 and the first binaural beamformer signal 36 are mixed according to the first mixing parameter 40 in each frequency band, in order to generate a first output signal 42 which is converted into a first output sound 44 by a first output trasducer 46 of the first local unit 21. In particular, the mixing in different frequency bands may affect the phase and magnitude components of the first binaural beamfomer signal 36 and the first reference signal 32, and their respective contributions to the phase and magnitude components of the first output signal 42, in a different way.

In a similar way, in the second local unit 22, a second binaural beamformer signal 48 is generated from the first reference signal 32 and the second reference signal 34, and a second coherence parameter 50 and a second mixing parameter 52 are derived from the second binaural beamformer signal 48 and the second reference signal 34. Finally, the second reference signal 34 and the second binaural beamformer signal 48 are mixed according to the second mixing parameter 52 in each frequency band, in order to generate a second output signal 54 which is converted into a second output sound 56 by a second output trasducer 58 of the second local unit 21. In this embodiment and in the following, each of the first and the second output transducer 46, 58 may be given, without any restriction, bys a loudspeaker, a balanced metal-case receiver or the like.

FIG. 4 shows a schematical block diagram of a different embodiment of a binaural hearing aid 20 as an extension of the embodiment shown in FIG. 3. Here, the first and second local units 21, 22 each comprise a front input transducer and a rear input transducer. The front input transducer of the first local unit 21 acts as the first input transducer 24, so its generated input signal is taken as the first reference signal 32. The rear input transducer of the first local unit 21 acts as a first supplementary input transducer 60, generating a first supplementary input signal 62. In the second local unit 22, the front input transducer acts as the second input transducer 28, generating the second input signal 30 which is taken as the second reference signal 34, while the rear input transducer acts as a second supplementary input transducer 64, generating a second supplementary input signal 66. The first binaural beamformer signal 36 is generated from the first reference signal 32, the first supplementary input signal 62 and the second reference signal 34. The second binaural beamformer signal 48 is generated from the second reference signal 34, the second supplementary input signal 66 and the first reference signal 32. The mixing of the first reference signal 32 and the first binaural beamformer signal 36 in dependence of the first coherence parameter 38 and according to the first mixing parameter 40 in order to generate the first output signal 42 is implemented in an analogous way as represented in FIG. 3. The same holds for the generation of the second output signal 54 of FIG. 4.

FIG. 5 shows a schematical block diagram of yet another embodiment of a binaural hearing aid 20 as an extension of the embodiment shown in FIG. 4.

Here, the first input signal 26 as the first reference signal 32 and the first supplementary input signal 62 are used to generate a first local beamformer signal 68, i.e., a monaural beamformer signal using the front and rear input signals of the first local unit for pre-processing and preliminary directional noise reduction. Likewise, the second input signal 30 as the second reference signal 34 and the second supplementary input signal 66 are used to generate a second local beamformer signal 70. The first binaural beamformer signal 36 is then derived from the first local beamformer signal 68 and the second local beamformer signal 70, containing signal contribution from all of the four input signals 26, 30, 62, 66. Thereby, the first binaural beamformer signal 36 can be generated only from the first local beamformer signal 68 and the second local beamformer signal 70. However, in certain beamforming applications such as Minimum Variance Distortionless Response (MVDR) beamforming, three input signals are used. Applied to this embodiment, the first supplementary input signal 60 may be used as said third signal to the beamformer generating the first binaural beamformer signal 36. This is indicated by a dottet line.

The second binaural beamformer signal 48 is derived in a similar way from the first local beamformer signal 68 and the second local beamformer signal 70, and in particular, with the possibility of adding the second supplementary signal 66 as a third signal to the second binaural beamformer signal 48 (dotted line). The first and the second output signal 42, 56 is then generated from the first or second binaural beamformer signal 36, 48 and from the first or second reference signal 32, 34, respectively, in an analogous way as shown in FIG. 3. Note that the reference signals 32, 34 for generating the mixing parameters and for the mixing process itself contain only signal contributions from one input signal 26, 30, respectively.

FIG. 6 shows a schematical block diagram an embodiment of a binaural hearing aid 20 similar to the embodiment shown in FIG. 5. However, now the first and second local beamformer signals 68, 70 are taken as first and second reference signals 32, 34, respectively, for the generation of the first and second output signals 42, 56. The first input signal 26 is only used to generate the first local beamformer signal 68, while the latter now takes the role of the first reference signal 32. Again, the dotted lines represent the possibility of adding the first and second supplementary input signals 62, 66 directly into the beamformers which generate the respective first and second binaural beamformer signals 36, 48.

Even though the invention has been illustrated and described in detail with help of a preferred embodiment example, the invention is not restricted by this example. Other variations can be derived by a person skilled in the art without leaving the extent of protection of this invention.

REFERENCE NUMERAL

1 hearing situation
2 user (of a binaural hearing system)
4 target speaker
6-12 non-target speakers
14 beam
20 binaural hearing aid
21 first local unit
22 second local unit
24 first input transducer
25 environment sound
26 first input signal
28 second input transducer
30 second input signal
32 first reference signal
34 second reference signal
36 first binaural beamformer signal
38 first coherence parameter
40 first mixing parameter
42 first output signal
44 first output sound
46 first output transducer
48 second binaural beamformer signal
50 second coherence parameter
52 second mixing parameter
54 second output signal

56 second output sound
58 second output transducer
60 first supplementary input transducer
62 first supplementary input signal
64 second supplementary input transducer
66 second supplementary input signal
68 first local beamformer signal
70 second local beamformer signal

The invention claimed is:

1. A method for improving the spatial hearing perception of a binaural hearing aid, said binaural hearing aid comprising a first local unit and a second local unit, wherein in the first local unit, a first input signal is generated from an environment sound by a first input transducer, and a first reference signal is derived from the first input signal, wherein in the second local unit, a second input signal is generated from the environment sound by a second input transducer, and a second reference signal is derived from the second input signal, wherein from the first reference signal and the second reference signal, a first binaural beamformer signal is derived, wherein from the first reference signal and the first binaural beamformer signal, a first coherence parameter is derived, wherein from the first coherence parameter, a first mixing parameter is derived, wherein the first reference signal and the first binaural beamformer signal are mixed by means of the first mixing parameter in order to generate a first output signal, wherein in the first local unit, a first supplementary input signal is generated from the environment sound by a first supplementary input transducer, wherein the first binaural beamformer signal is derived from at least the first supplementary input signal, wherein in the second local unit, a second supplementary input signal is generated from the environment sound by a second supplementary input transducer, wherein the first binaural beamformer signal is derived from the second supplementary input signal, wherein the first reference signal is generated from the first input signal, wherein the second reference signal is generated from the second input signal, wherein in the first local unit, a first local beamformer signal is generated from the first reference signal and the first supplementary input signal, wherein in the second local unit, a second local beamformer signal is generated from the second reference signal and the second supplementary input signal, and wherein the first binaural beamformer signal is derived from the first local beamformer signal and the second local beamformer signal.

2. The method according to claim 1, wherein the first reference signal is derived from a set of first input signals, each of which is generated from the environment sound by a corresponding input transducer in the first local unit.

3. The method according to claim 1, wherein at least for a number of frequency bands, a magnitude of the first output signal is obtained as a linear superposition of a magnitude of the first binaural beamformer signal and a magnitude of the first reference signal, and wherein in said linear superposition, the magnitude of the first binaural beamformer signal and the magnitude of the first reference signal are mixed according to the first mixing parameter.

4. The method according to claim 3, wherein in dependence of the first coherence parameter, a first magnitude threshold value is derived, and wherein the first mixing parameter is obtained in dependence of a comparison of the first coherence parameter with the first magnitude threshold value.

5. The method according to claim 4, wherein the first coherence parameter is calculated for a plurality of subsequent time-frequency bins, and wherein the first magnitude threshold for a frequency band is derived from a time average of the corresponding time-frequency bins of the first coherence parameter.

6. The method according to claim 1, wherein a first phase threshold value is compared to a phase of the first coherence parameter, and wherein at least for a number of frequency bands, in dependence of said comparison a phase of the first output signal is obtained from a phase of the first reference signal and/or from a phase of the first binaural beamformer signal.

7. A binaural hearing aid, comprising a first local unit with at least a first input transducer for converting an environment sound into at least a first input signal, and a second local unit with at least a second input transducer for converting the environment sound into at least a second input signal, and a signal processing unit configured to perform the method according to claim 1.

8. A method for improving the spatial hearing perception of a binaural hearing aid, said binaural hearing aid comprising a first local unit and a second local unit, wherein in the first local unit, a first input signal is generated from an environment sound by a first input transducer, and a first reference signal is derived from the first input signal, wherein in the second local unit, a second input signal is generated from the environment sound by a second input transducer, and a second reference signal is derived from the second input signal, wherein from the first reference signal and the second reference signal, a first binaural beamformer signal is derived, wherein from the first reference signal and the first binaural beamformer signal, a first coherence parameter is derived, wherein from the first coherence parameter, a first mixing parameter is derived, wherein the first reference signal and the first binaural beamformer signal are mixed by means of the first mixing parameter in order to generate a first output signal, wherein in the first local unit, a first supplementary input signal is generated from the environment sound by a first supplementary input transducer, wherein the first binaural beamformer signal is derived from at least the first supplementary input signal, wherein in the second local unit, a second supplementary input signal is generated from the environment sound by a second supplementary input transducer, wherein the first binaural beamformer signal is derived from the second supplementary input signal, wherein in the first local unit, the first reference signal is generated from the first input signal and the first supplementary input signal as a first local beamformer signal, wherein in the second local unit, the second reference signal is generated from the second input signal and the second supplementary input signal as a second local beamformer signal, and wherein the first binaural beamformer signal is derived from the first reference signal and the second reference signal.

9. The method according to claim 8, wherein the first reference signal is derived from a set of first input signals, each of which is generated from the environment sound by a corresponding input transducer in the first local unit.

10. The method according to claim 8, wherein at least for a number of frequency bands, a magnitude of the first output signal is obtained as a linear superposition of a magnitude of the first binaural beamformer signal and a magnitude of the first reference signal, and wherein in said linear superposition, the magnitude of the first binaural beamformer signal and the magnitude of the first reference signal are mixed according to the first mixing parameter.

11. The method according to claim 10, wherein in dependence of the first coherence parameter, a first magnitude threshold value is derived, and wherein the first mixing parameter is obtained in dependence of a comparison of the first coherence parameter with the first magnitude threshold value.

12. The method according to claim 11, wherein the first coherence parameter is calculated for a plurality of subsequent time-frequency bins, and wherein the first magnitude threshold for a frequency band is derived from a time average of the corresponding time-frequency bins of the first coherence parameter.

13. The method according to claim 8, wherein a first phase threshold value is compared to a phase of the first coherence parameter, and wherein at least for a number of frequency bands, in dependence of said comparison a phase of the first output signal is obtained from a phase of the first reference signal and/or from a phase of the first binaural beamformer signal.

14. A binaural hearing aid, comprising a first local unit with at least a first input transducer for converting an environment sound into at least a first input signal, and a second local unit with at least a second input transducer for converting the environment sound into at least a second input signal, and a signal processing unit configured to perform the method according to claim 8.

* * * * *